US010759619B2

(12) United States Patent
Sugiura

(10) Patent No.: US 10,759,619 B2
(45) Date of Patent: Sep. 1, 2020

(54) IMAGE FORMING APPARATUS

(71) Applicant: CANON KABUSHIKI KAISHA, Tokyo (JP)

(72) Inventor: Tadao Sugiura, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/149,477

(22) Filed: Oct. 2, 2018

(65) Prior Publication Data

US 2019/0112141 A1 Apr. 18, 2019

(30) Foreign Application Priority Data

Oct. 13, 2017 (JP) ..... 2017-199602

(51) Int. Cl.

| | |
|---|---|
| ***B65H 7/02*** | (2006.01) |
| ***B65H 9/20*** | (2006.01) |
| ***B65H 1/26*** | (2006.01) |
| ***B65H 5/06*** | (2006.01) |
| ***B65H 7/20*** | (2006.01) |
| ***G03G 15/00*** | (2006.01) |

(52) U.S. Cl.

CPC ..... *B65H 9/20* (2013.01); *B65H 1/266* (2013.01); *B65H 5/062* (2013.01); *B65H 7/02* (2013.01); *B65H 7/20* (2013.01); *G03G 15/5095* (2013.01); *G03G 15/6594* (2013.01); *B65H 2511/10* (2013.01); *B65H 2511/11* (2013.01); *B65H 2511/16* (2013.01); *B65H 2511/20* (2013.01); *B65H 2551/20* (2013.01); *B65H 2801/06* (2013.01)

(58) Field of Classification Search

CPC ..... B65H 7/00; B65H 43/00; B65H 2551/00; B65H 1/04; B65H 9/20; B65H 7/02; B65H 7/20

See application file for complete search history.

(56) References Cited

U.S. PATENT DOCUMENTS

| | | | | |
|---|---|---|---|---|
| 9,475,663 | B2 | 10/2016 | Takata et al. | |
| 2009/0066011 | A1* | 3/2009 | Ohno | B65H 1/266 271/171 |
| 2015/0375955 | A1* | 12/2015 | Kanematsu | B65H 43/00 271/2 |

FOREIGN PATENT DOCUMENTS

| | | |
|---|---|---|
| JP | 07-112844 A | 5/1995 |

* cited by examiner

*Primary Examiner* — Thomas A Morrison
(74) *Attorney, Agent, or Firm* — Venable LLP

(57) ABSTRACT

An image forming apparatus includes an image forming unit configured to form an image on a sheet fed from a container; a trailing edge regulating plate, which is movable in a feeding direction inside the container, and is configured to regulate a trailing edge position of the sheet; a detector configured to automatically detect a sheet size based on the position of the trailing edge regulating plate; and a receiver configured to receive a size of the sheet to be set for the container as a user set size.

7 Claims, 8 Drawing Sheets

| | | | | USER SET SIZE (SHEET LENGTH) | | | | | | | | | | |
|---|---|---|---|---|---|---|---|---|---|---|---|---|---|---|
| DETECTION RESULT OF CASSETTE SHEET LENGTH (mm) | SW3 | SW4 | SW5 | ~211.5 | ~221.5 | ~252.0 | ~262.0 | ~267.5 | ~277.5 | ~281.5 | ~290.9 | ~298.5 | ~308.5 | ~355.6 |
| 190.5~221.5 | OFF | ON | ON | A | A | N/A | N/A | N/A | N/A | N/A | N/A | N/A | N/A | N/A |
| 221.6~262.0 | OFF | ON | OFF | N/A | A | A | A | N/A | N/A | N/A | N/A | N/A | N/A | N/A |
| 262.1~277.5 | OFF | OFF | OFF | N/A | N/A | A | A | A | A | N/A | N/A | N/A | N/A | N/A |
| 277.6~281.5 | OFF | OFF | ON | N/A | N/A | N/A | N/A | N/A | A | A | N/A | N/A | N/A | N/A |
| 281.6~290.9 | OFF | ON | OFF | N/A | N/A | N/A | N/A | N/A | N/A | A | A | N/A | N/A | N/A |
| 291.0~308.5 | ON | OFF | OFF | N/A | N/A | N/A | N/A | N/A | N/A | N/A | A | A | A | N/A |
| 308.6~ | ON | ON | OFF | N/A | N/A | N/A | N/A | N/A | N/A | N/A | N/A | N/A | A | A |

FIG. 5A

| | | | | USER SET SIZE (SHEET WIDTH) | | | | | | | |
|---|---|---|---|---|---|---|---|---|---|---|---|
| DETECTION RESULT OF CASSETTE SHEET WIDTH (mm) | SW0 | SW1 | SW2 | ~129.7 | ~139.7 | ~172.0 | ~182.0 | ~185.0 | ~195.0 | ~206.0 | ~216.0 |
| ~98.4 | ON | OFF | ON | A | A | N/A | N/A | N/A | N/A | N/A | N/A |
| 98.5~139.7 | ON | OFF | OFF | N/A | A | A | N/A | N/A | N/A | N/A | N/A |
| 139.8~182.0 | ON | ON | OFF | N/A | N/A | N/A | A | A | N/A | N/A | N/A |
| 182.1~195.0 | ON | ON | ON | N/A | N/A | N/A | N/A | N/A | A | A | N/A |
| 195.1~ | OFF | ON | ON | N/A | N/A | N/A | N/A | N/A | N/A | N/A | A |

FIG. 5B

IMAGE FORMING APPARATUS

BACKGROUND OF THE INVENTION

Field of the Invention

The present disclosure relates to an image forming apparatus.

Description of the Related Art

In general, a copying machine, a printing apparatus, or other such image forming apparatus includes a sheet feeding cassette configured to store sheets. The sheet feeding cassette is configured so as to be able to store sheets of A-series sizes (A3, A4, and A5), B-series sizes (B4 and B5), sizes defined in inches (LGL and LTR), and other various sizes from large sizes to small sizes. Moreover, size information on currently stored sheets is set for the sheet feeding cassette in advance, which prevents a sheet of a wrong size from being fed to be subjected to image formation.

In Japanese Patent Application Laid-open No. Hei 7-112844, the following method is proposed as a method of setting a sheet size. That is, in an image forming apparatus of Japanese Patent Application Laid-open No. Hei 7-112844, a trailing edge guide and a side guide, which are configured to regulate the movement of a trailing edge and a side edge of sheets, respectively, are provided to a cassette, and the size of the sheets stored in the cassette is automatically detected based on the positions of the trailing edge guide and the side guide. There is also generally known a method of setting sheet size information (user set size), which is input by a user through use of an operating device, for the sheet feeding cassette.

When the trailing edge guide or the side guide is not correctly set at a position at which the trailing edge guide or the side guide abuts against the trailing edge or the side edge of sheets, respectively, there are a fear that one sheet may move in a direction reverse to a feeding direction in reaction to the feeding of another sheet and a fear that skew feeding of a sheet may occur while the sheet is being fed. In U.S. Pat. No. 9,475,663 B2, there is proposed a method of displaying a warning screen when it is determined that the automatically detected sheet size and the sheet size set by the user do not match each other.

SUMMARY OF THE INVENTION

An image forming apparatus according to the present disclosure includes: a container configured to store a sheet; an image forming unit configured to form an image on the sheet fed from the container; a trailing edge regulating plate, which is movable in a feeding direction of the sheet inside the container, and is configured to regulate a position of a trailing edge of the sheet in the feeding direction; a detector configured to detect a size of the sheet based on the position of the trailing edge regulating plate; a receiver configured to receive a size of the sheet to be set for the container based on a user instruction; an attachment, which is to be mounted to the trailing edge regulating plate, and is configured to regulate the position of the trailing edge of the sheet having a sheet size smaller than an applicable sheet size of the trailing edge regulating plate; and a determination unit, wherein the determination unit is configured to: determine, in a case where a length in the feeding direction of the size received by the receiver is longer than a predetermined length, whether to notify a user of a warning based on the size of the sheet received by the receiver and the size of the sheet detected by the detector; and determine, in a case where the length in the feeding direction of the size of the sheet received by the receiver is shorter than the predetermined length, whether to notify the user of the warning based on the size of the sheet received by the receiver, the size of the sheet detected by the detector, and a length of the attachment in the feeding direction.

Further features of the present invention will become apparent from the following description of exemplary embodiments (with reference to the attached drawings).

BRIEF DESCRIPTION OF THE DRAWINGS

FIG. 5A and FIG. 5B are each a table for showing a relationship between a detection result of the sheet size and a user set size.

DESCRIPTION OF THE EMBODIMENTS

Image Forming Apparatus

Figure 1A:
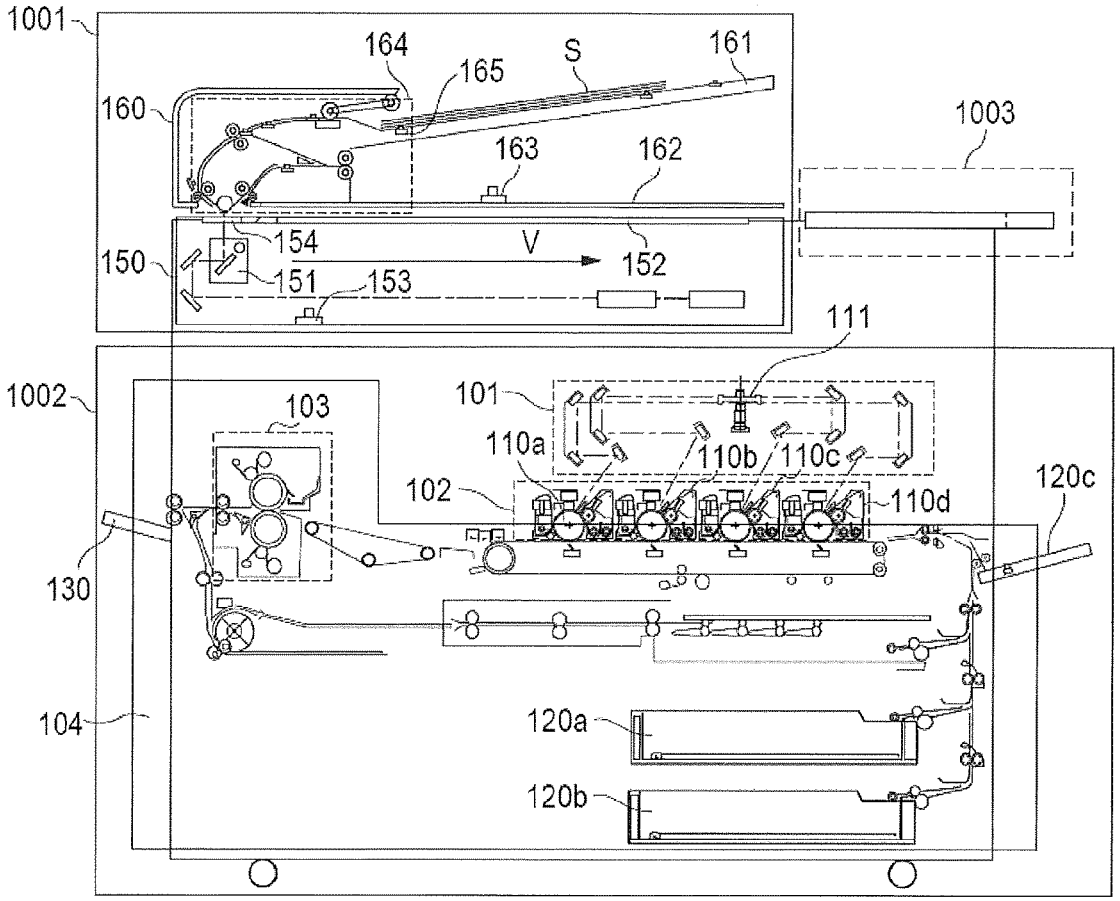
FIG. 1A is a sectional view of an image forming apparatus.

Now, a preferred embodiment of the present invention is described with reference to the accompanying drawings. FIG. 1A is a sectional view for illustrating a schematic configuration of a full-color copying machine being an example of an image forming apparatus. The image forming apparatus of FIG. 1A includes a reader 1001, a printer 1002, and an operating device 1003. The reader 1001 includes an image reading unit 150, and is configured to optically read an image on an original, and generate image data by converting the read image into an electric signal. The reader 1001 further includes an automatic document feeder (hereinafter referred to as "ADF") 160, and is configured to convey originals S stacked on an original tray 161 to an original flow reading glass 154 one by one by a conveyor 164 indicated by the broken line in FIG. 1A.

FIG. 1A is an example of an image forming apparatus according to a first embodiment of the present invention, and is a vertical sectional view for illustrating the schematic configuration of the full-color copying machine. The image forming apparatus includes the reader 1001, the printer 1002, and the operating device 1003. The reader 1001 includes the image reading unit 150 and the ADF 160. The image reading unit 150 is configured to optically read an original image by illuminating an original, and create image data by converting the read image into an electric signal. The reader 1001 includes the ADF 160, and is configured to convey the originals S stacked on the original tray 161 to the original flow reading glass 154 one by one by the conveyor 164 indicated by the broken line in FIG. 1A. Then, the image on the original conveyed onto the original flow reading glass 154 is read by an optical scanner unit 151 located below the original flow reading glass 154. The original is read by the optical scanner unit 151, and then is delivered onto an original delivery tray 162 by the conveyor 164. A delivered-original detection sensor 163 is configured to detect the presence or absence of the original delivered onto the original delivery tray 162. Moreover, an original presence detection sensor 165 is configured to detect whether or not the originals S are stacked on the original tray 161.

The printer 1002 includes a laser exposure device 101, an imager 102, and a fixer 103, each of which is indicated by the broken line frame part, sheet feeding cassettes 120*a* and 120*b*, and a feeder/conveyor 104 (solid line frame part) including a manual feed tray 120*c*. The sheet feeding cassettes 120*a* and 120*b* and the manual feed tray 120*c* are sheet containers configured to store sheets of a plurality of sizes. The imager 102 is an image forming unit including photosensitive drums 110*a*, 110*b*, 110*c*, and 110*d* (hereinafter denoted by "110*a* to 110*d*").

The laser exposure device 101 causes laser light modulated in accordance with the image data to enter a rotary polygon mirror 111 rotating at a constant angular velocity, and to thereby apply the laser light to the photosensitive drums 110*a* to 110*d* as reflected scanning light indicated by the one-dot chain line in FIG. 1A to form latent images thereon. The imager 102 drives the photosensitive drums 110*a* to 110*d* to rotate, causes a charger to charge the photosensitive drums 110*a* to 110*d*, causes the laser exposure device 101 to develop the latent images formed on the photosensitive drums 110*a* to 110*d* through use of toners, and transfers toner images onto a sheet fed from the sheet container. The four photosensitive drums 110*a* to 110*d* are arrayed for forming images of yellow (Y), magenta (M), cyan (C), and black (K) in the stated order, and are configured to sequentially perform an image forming operation after elapse of a predetermined time period from the start of image formation. Under this timing control, the toner images of the respective colors are transferred onto the sheet while being superimposed on one another to form a full-color toner image. The fixer 103 is formed of a combination of a roller and a belt, and includes a halogen heater or other such heat source. The fixer 103 is configured to melt and fix an unfixed full-color toner image, which is formed on the sheet by the imager 102, by heat and pressure.

The feeder/conveyor 104 is configured to separate the sheets stored in any one of the containers, namely, the sheet feeding cassettes 120*a* and 120*b* and the manual feed tray 120*c*, one by one, and convey the separated sheet to the imager 102. As described above, the toner images of the respective colors are transferred onto the sheet conveyed to the imager 102, fixed thereto by the fixer 103, and delivered onto a delivery tray 130.

The operating device 1003 is a receiver configured to receive a user instruction, and includes a key input device 4000 and a touch panel 4001. The key input device 4000 is operated by a user touching a key. A power switch 401 is a switch for switching between power-on and power-off of the entire image forming apparatus. A start key 402 is a key for instructing to start execution of a copy job for performing an original reading operation and a printing operation, and a stop key 403 is a key for instructing to interrupt the copy job. Numeric keys 404 indicated by the broken line frame part are keys for setting the number of copies. A clear key 405 is a key for returning a set value of a copy mode to an initial value. A user mode key 406 is a key for transitioning to a screen for performing system setting, various kinds of adjustment, and other such operations. The touch panel 4001 allows the user to input information by touching a touch panel 301, and also functions as a display for displaying information. On the touch panel 4001, the number of copies, a magnification, a selected sheet, a copy density, the copy mode, system conditions, and other such information are displayed.

Control Blocks

Figure 2A:
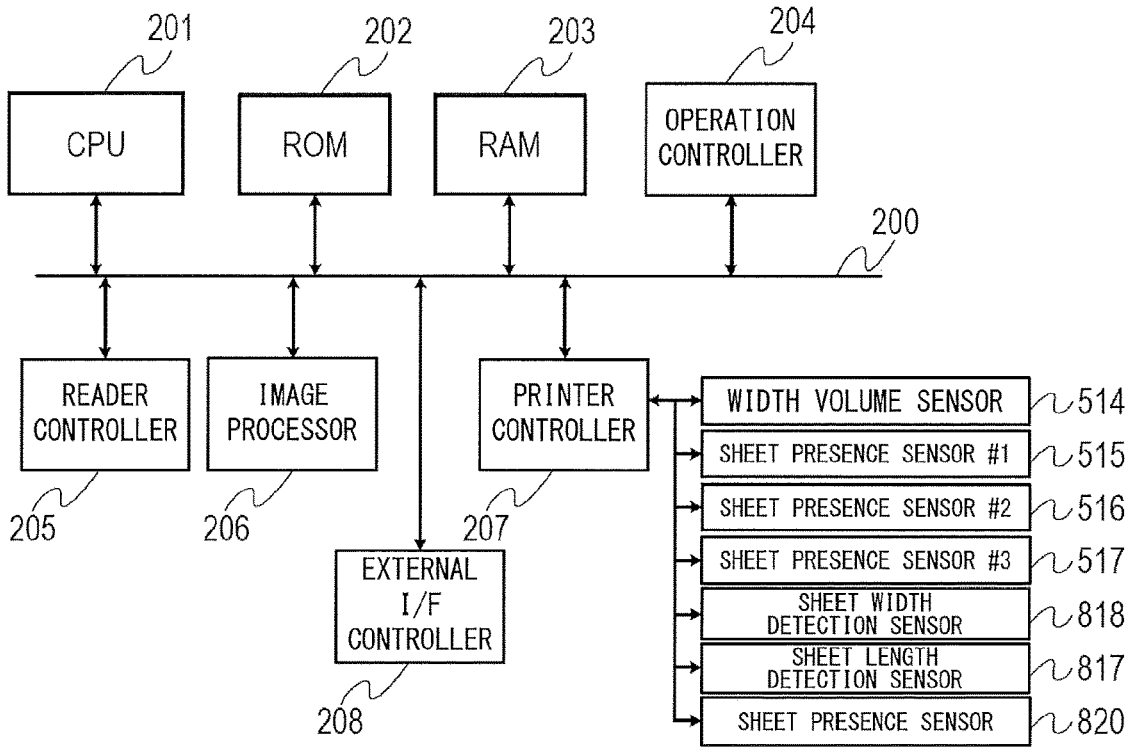
FIG. 2A is a control block diagram of the image forming apparatus.

FIG. 2A is a control block diagram of the image forming apparatus according to this embodiment. The image forming apparatus includes a CPU 201, a ROM 202, a RAM 203, an operation controller 204, a reader controller 205, an image processor 206, an external I/F controller 208, and a printer controller 207, which are connected to one another via a system bus 200. The CPU 201 is a controller configured to control the image forming apparatus. A program for executing processing of a flow chart (described later) is written to the ROM 202. The CPU 201 is configured to execute the program to provide various functions. The RAM 203 is used as a work memory to be used when the CPU 201 performs various kinds of arithmetic operation processing. The operation controller 204 is an electric circuit configured to control the components of the operating device 1003. The reader controller 205 and the printer controller 207 are each an electric circuit including an input/output port and being configured to control the components of the reader 1001 and the printer 1002, respectively. The printer controller 207 is configured to control detectors such as a width volume sensor 514, sheet presence sensors 515, 516, and 517, a sheet width detection sensor 818, a sheet length detection sensor 817, and a sheet presence sensor 820. The printer controller 207 includes respective drive circuits for pickup rollers 811 illustrated in FIG. 3. The CPU 201 is configured to control the reader controller 205 and the printer controller 207 based on the program stored in the ROM 202 to perform the image forming operation.

The image processor 206 is configured to perform various kinds of image processing on digital data on the original image converted by the reader controller 205, and output the data subjected to the image processing to the printer controller 207. The external I/F controller 208 is an electric circuit configured to connect the image forming apparatus to a server, a personal computer, or other such external device via a LAN cable or a USB cable, and control communication to/from the external device.

Block Diagram of Operation Controller

Figure 1B:
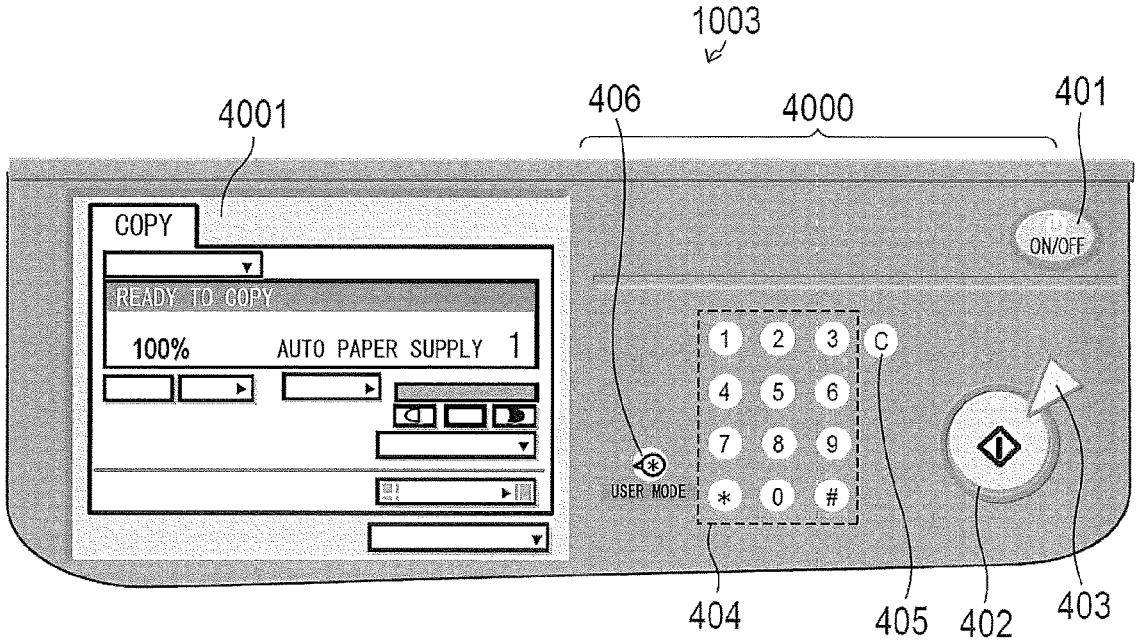
FIG. 1B is a top view of an operating device illustrated in FIG. 1A.
Figure 2B:
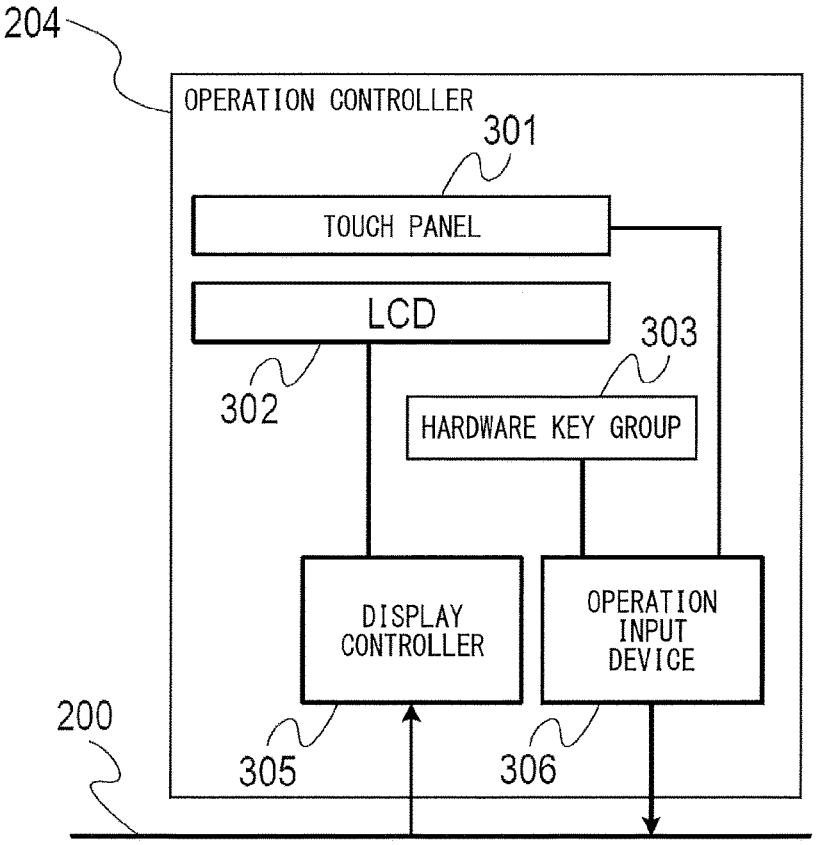
FIG. 2B is a block diagram for illustrating details of an operation controller illustrated in FIG. 2A.

FIG. 2B is a block diagram for illustrating details of the operation controller 204. The touch panel 301 and a hardware key group 303 (corresponding to 402 to 406 in FIG. 1B) are connected to the system bus 200 via an operation input device 306. Then, coordinate information indicating a pressing position of the touch panel 301 and key information indicating a pressed key of the hardware key group 303 are output to the system bus 200 via the operation input device 306. An LCD 302 is connected to the system bus 200 via a display controller 305. The display controller 305 and the operation input device 306 are connected to the CPU 201, the ROM 202, and the RAM 203 via the system bus 200. The ROM 202 is configured to store not only the control program but also data on a setting screen, data on a display key, and other such data for various kinds of operation modes. The RAM 203 is configured to store a current setting status of the image forming apparatus. When the coordinate information and the key information are input from the operation input device 306, the CPU 201 operates in the following manner. The CPU 201 selects the setting screen and the display key corresponding to the current setting status of the image forming apparatus and an operation performed on the touch panel 301 or the hardware key group 303 by the user, and transfers the setting screen and the display key to the display controller 305 as the display data. The display controller 305 transmits the display data transferred by the CPU 201 to the LCD 302, and the LCD 302 visibly displays the transferred display data.

Configuration of Sheet Feeding Cassette

Figure 3A:
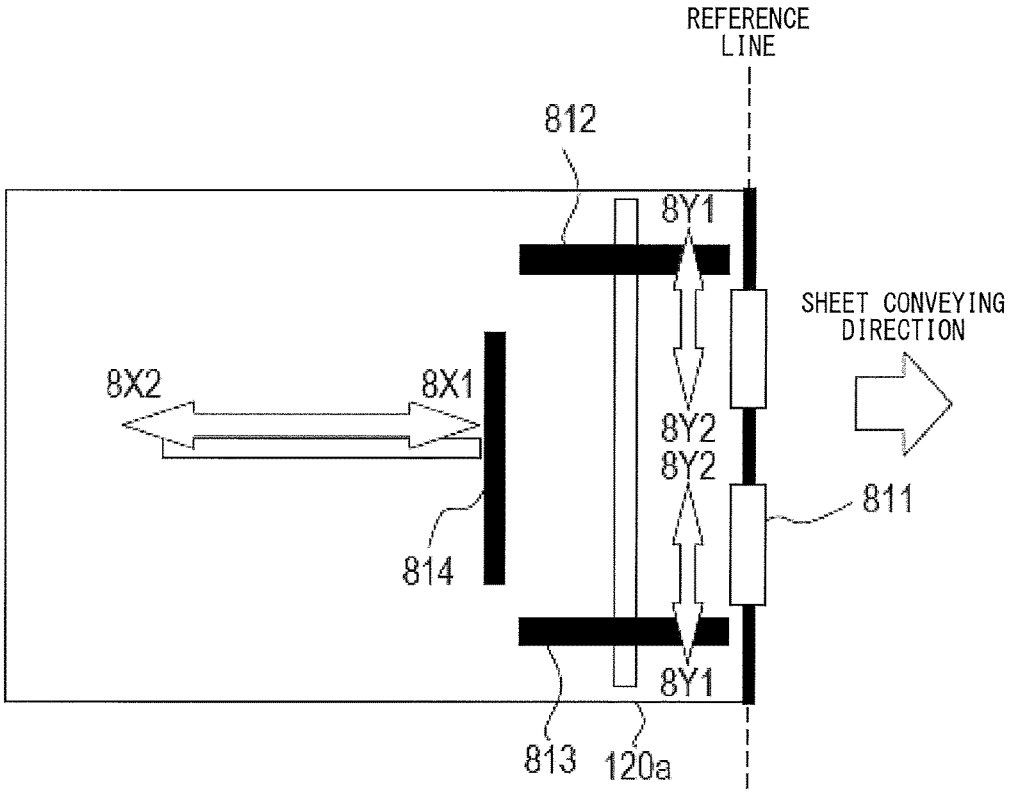
FIG. 3A, FIG. 3B, and FIG. 3C are each a configuration view of a sheet feeding cassette.
Figure 3B:
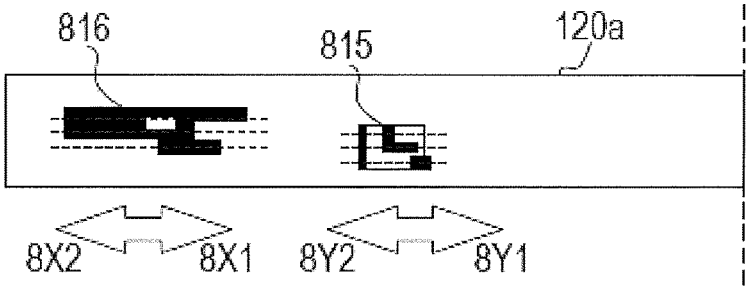
Figure 3C:
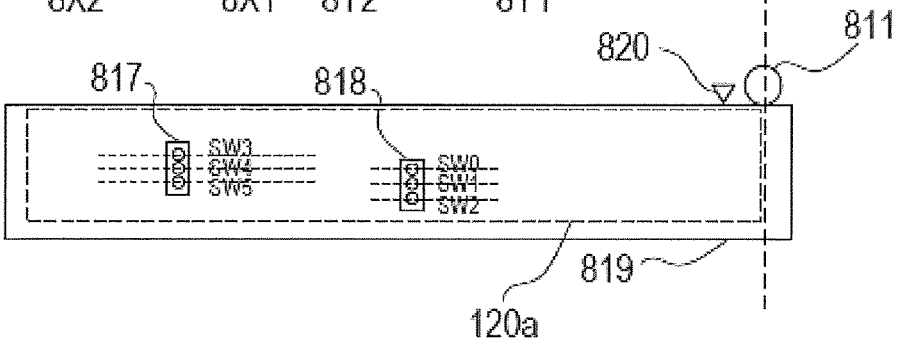

With reference to FIG. 3, a description is given of a configuration of the sheet feeding cassette 120*a* being an example of a container in this embodiment. FIG. 3A is a top view of the sheet feeding cassette 120*a* with the front of the image forming apparatus at the bottom, and FIG. 3B and FIG. 3C are each a back side view of the sheet feeding cassette 120*a* obtained when the sheet feeding cassette 120*a* is virtually viewed through from the front of the image forming apparatus. FIG. 3C is also a front view of the sheet feeding cassette 120*a* obtained when the sheet feeding cassette 120*a* is inserted into the image forming apparatus.

The sheet feeding cassette 120*a* enables sheets to be supplied thereto under a state in which the sheet feeding cassette 120*a* is pulled out from a main body 819 on the image forming apparatus side, and enables the printing operation to be performed under a state in which the sheet feeding cassette 120*a* is accommodated in the main body 819 on the image forming apparatus side.

A plurality of sheets can be stacked on the sheet feeding cassette 120*a*, and are fed to the imager 102 in order from the top sheet by the pickup rollers 811 provided in the vicinity of the main body 819. Side edge regulating plates 812 and 813 are configured so as to be slidable in directions indicated by the arrows 8Y1 and 8Y2 in conjunction with each other, and are configured to sandwich the stacked sheets at side edges thereof in a width direction thereof, to thereby prevent a sheet from being conveyed while being skew-fed.

The side edge regulating plates 812 and 813 are provided so as to be movable in the directions indicated by the arrows 8Y1 and 8Y2, which correspond to the width direction perpendicular to a feeding direction of the sheet, and are configured to regulate the stacked sheets at the side edges in the width direction, to thereby prevent a sheet from being fed while being skew-fed. Moreover, the side edge regulating plates 812 and 813 are coupled to a sheet width detection plate 815 illustrated in FIG. 3B via a link mechanism (not shown), and the sheet width detection plate 815 is configured to slide in the directions indicated by the arrows 8Y1 and 8Y2, which correspond to a direction perpendicular to the feeding direction of the sheet, in accordance with the movement of the side edge regulating plates 812 and 813. In this embodiment, the side edge regulating plates 812 and 813 are capable of regulating sheets having a sheet width ranging from 98.5 mm to 215.0 mm.

A trailing edge regulating plate 814 is configured so as to be movable in directions indicated by the arrows 8X1 and 8X2, which correspond to a feeding direction of a sheet, and is configured to regulate the position of a trailing edge of the sheet in the feeding direction of the sheet. With this configuration, the trailing edge regulating plate 814 prevents one sheet from moving in a direction reverse to the feeding direction in reaction to the feeding of another sheet from the stacked sheets. Moreover, the trailing edge regulating plate 814 is coupled to a sheet length detection plate 816 via a link mechanism (not shown), and the sheet length detection plate 816 is configured to slide in the directions indicated by the arrows 8X1 and 8X2 in conjunction with the position of the trailing edge regulating plate 814. In this embodiment, the trailing edge regulating plate 814 is capable of regulating the trailing edge of sheets having a sheet length ranging from 190.5 mm to 355.6 mm.

The sheet width detection sensor 818 provided to the main body 819 is formed of a triple switch, namely, switches SW0, SW1, and SW2, and is configured to detect the sheet width under the state in which the sheet feeding cassette 120*a* is inserted in the main body 819. Specifically, a combination of on/off states of the switches SW0, SW1, and SW2 is detected as information on a shape formed by positions on the broken lines illustrated in FIG. 3B of the sheet width detection plate 815, which is configured to slide in the directions indicated by the arrows 8Y1 and 8Y2 in conjunction with the side edge regulating plates 812 and 813.

Similarly, the sheet length detection sensor 817 provided to the main body 819 is formed of a triple switch, namely, switches SW3, SW4, and SW5, and is configured to detect the sheet length under the state in which the sheet feeding cassette 120*a* is inserted in the main body 819. Specifically, a combination of on/off states of the switches SW3, SW4, and SW5 is detected as information on a shape formed by positions on the broken lines illustrated in FIG. 3C of the sheet length detection plate 816, which is configured to slide in the directions indicated by the arrows 8X1 and 8X2 in conjunction with the trailing edge regulating plate 814.

The sheet presence sensor 820 provided to the main body 819 is configured to detect a sheet surface of a sheet placed at the top surface among a plurality of sheets stored in the sheet feeding cassette 120*a*. The CPU 201 is configured to drive or stop a lift-up motor (not shown) based on detection results obtained by the sheet width detection sensor 818, the sheet length detection sensor 817, and the sheet presence sensor 820. With this configuration, the CPU 201 performs a lift-up operation for lifting up the sheets stacked on the sheet feeding cassette 120*a* to such a height as to enable sheet feeding by the pickup rollers 811. Then, the CPU 201 performs an operation for determining the presence or absence of a sheet on the sheet feeding cassette 120*a* with the sheets being lifted up to such a height as to enable sheet feeding.

User Set Size

In this embodiment, a mechanism for automatically detecting the size of sheets stored in a sheet feeding cassette is provided, but it is also possible to set a sheet size designated by the user for the sheet feeding cassette.

Figure 4A:
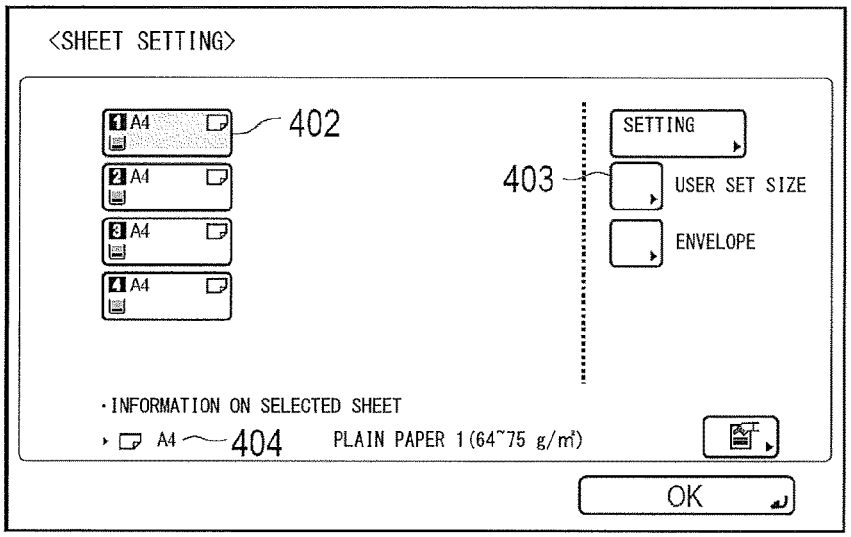
FIG. 4A, FIG. 4B, and FIG. 4C are each an illustration of a setting screen for a sheet size.
Figure 4B:
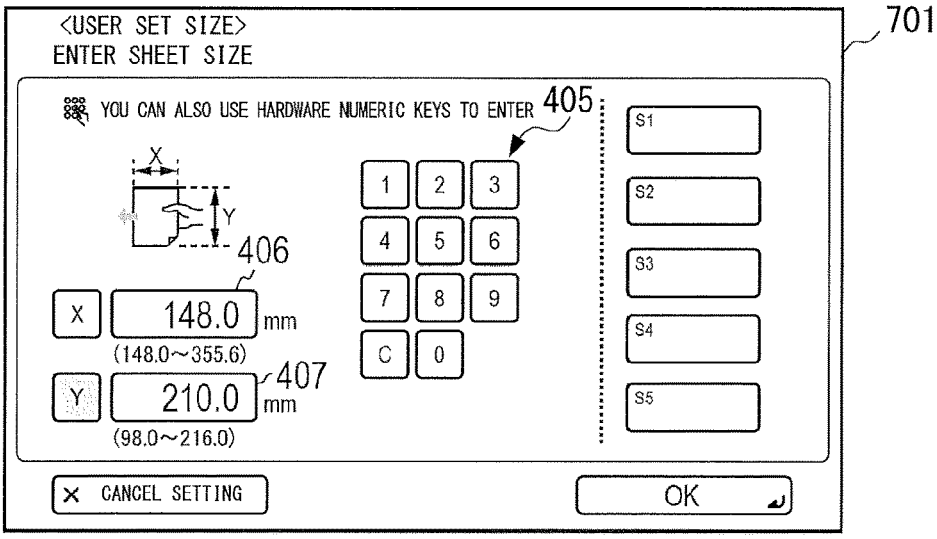
Figure 4C:
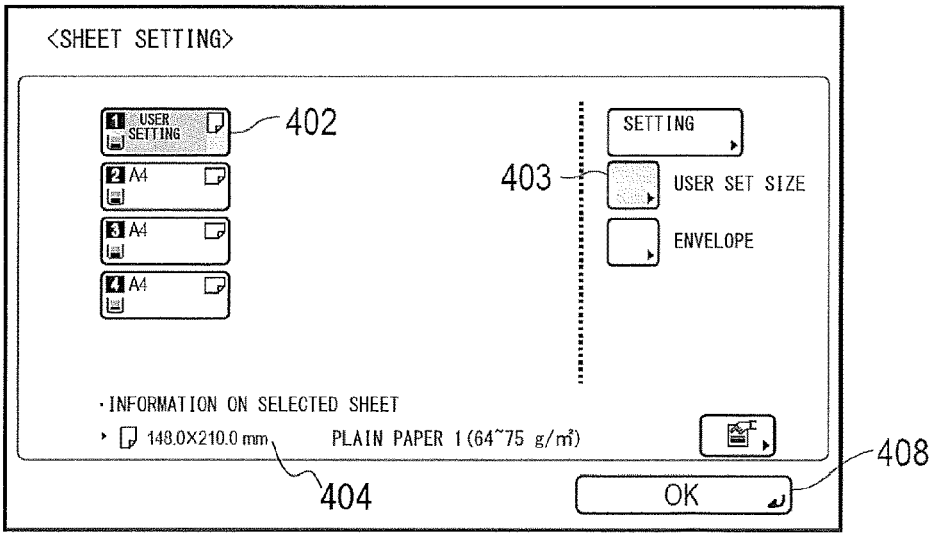

With reference to FIG. 4, a description is given of an example of setting the sheet size based on a user instruction. FIG. 4A to FIG. 4C are each a sheet size setting screen to be displayed on the operating device 1003.

In FIG. 4A, a sheet feeding cassette key 402 is a key for selecting a sheet feeding cassette for which the sheet size is to be set. On the sheet feeding cassette key 402, information on the sheet size registered for the sheet feeding cassette is displayed. When the sheet feeding cassette key 402 is pressed by the user, the sheet feeding cassette corresponding to the pressed key is selected as the sheet feeding cassette for which the sheet size is to be set. FIG. 4A is an illustration of a state in which the sheet feeding cassette 120*a* has been selected as the sheet feeding cassette for which the sheet size is to be set. A sheet information display area 404 is an area in which detailed information on sheets set in the selected sheet feeding cassette is displayed. Not only the information on the sheet size but also information on a sheet type and a basis weight are displayed in the sheet information display area 404. A user set size key 403 is a key for allowing the user to input the sheet size to be set for the selected sheet feeding cassette. When the user set size key 403 is pressed by the user, a transition is made to a user set size screen 701 illustrated in FIG. 4B.

FIG. 4B is an illustration of a screen to be displayed when the user set size key 403 is pressed. In FIG. 4B, a sheet size input area 406 is an area for inputting information on a length (sheet length) in a direction for feeding a sheet (feeding direction X), and a sheet size input area 407 is an area for inputting information on a length (sheet width) of a sheet in a width direction Y perpendicular to the feeding direction. Through input of the information on the sheet length and the sheet width to the sheet size input areas 406 and 407, it is possible to set an irregular size as well as a regular size. The user uses the numeric keys 4040 or a software keyboard displayed in FIG. 4B to designate the sheet sizes in the feeding direction X and the width direction Y. An OK key 405 is a key for setting the designated sheet size. When the OK key 405 is pressed, the CPU 201 sets the sheet size input on a user set size screen for the sheet feeding cassette for which the sheet size is to be set, and as illustrated in FIG. 4C, displays the information on the sheet size in the sheet information display area 404.

Sheet Size Detection for Sheet Feeding Cassette

Next, a description is given of processing for determining a match or a mismatch between the sheet size designated by the user (hereinafter referred to as "user set size") and the automatically detected sheet size (hereinafter referred to as "automatically detected size"). FIG. 5A is a correspondence table between detection results obtained by the switches SW3 to SW5 of the sheet length detection sensor 817 and the user set sizes. The correspondence table of FIG. 5A and a correspondence table of FIG. 5B are each stored in the ROM 202 or the RAM 203, and the CPU 201 determines a sheet size error based on the information of those correspondence tables.

FIG. 5A is a table for showing a relationship between the length in the feeding direction of the automatically detected size and the length in the feeding direction of the user set size. FIG. 5B is a table for showing a relationship between the length in the feeding direction of the automatically detected size and the length in the feeding direction of the user set size.

The first column of the table of FIG. 5A indicates the sheet length identified from the output states of the switches SW3 to SW5 of the sheet length detection sensor 817. The second to fourth columns of the table indicate the output states of the switches SW3 to SW5, respectively. The fifth column and the subsequent columns each indicate the user set size. In FIG. 5A, "N/A" indicates that the sheet length set as the user set size and an automatic detection result exhibit a mismatch (not applicable), namely, a setting error is determined. When a setting error is determined, the CPU 201 causes the operating device 1003 to display a sheet size error screen illustrated in FIG. 6 to notify the user of the setting error. "A" indicates that the sheet length set as the user set size and the automatic detection result exhibit a match, namely, no setting error is determined. In this case, the sheet size error screen is not displayed, and the user set size is determined as the set size of the sheet feeding cassette.

FIG. 5B is the correspondence table between the sheet size automatically detected based on the position of the trailing edge regulating plate 814 and the user set size. The first column of the table indicates a setting range of the sheet width. The second to fourth columns of the table indicate the output states of the switches SW0 to SW2 of the sheet length detection sensor 817, respectively. The fifth column and the subsequent columns each indicate the user set size. In FIG. 5B, "N/A" indicates that the sheet width set as the user set size and a detection result of the sheet size exhibit a mismatch, namely, a setting error is determined. When a setting error is determined, the CPU 201 causes the operating device 1003 to display the sheet size error screen illustrated in FIG. 6 to notify the user of the setting error. "A" indicates that the sheet width set as the user set size and the automatic detection result exhibit a match, namely, no setting error is determined.

For example, in a case where the detection results indicate that the switch SW3 is OFF, the switch SW4 is ON, and the switch SW5 is ON, it is understood from the table of FIG. 5A that the trailing edge regulating plate 814 is located at a position for regulating sheets having a length of 190.5 mm to 221.5 mm in the feeding direction. When the length in the feeding direction set as the user set size input on the sheet size setting screen is 190.5 mm to 221.5 mm, the automatically detected sheet size and the user set size match each other. Therefore, it is determined that the trailing edge regulating plate 814 is correctly set, and the sheet size error screen is not displayed. However, in a case where the length in the feeding direction set as the user set size input on the sheet size setting screen is longer than 221.5 mm, the user set size does not match the automatically detected sheet size, and hence the CPU 201 causes the operating device 1003 to display the sheet size error screen of FIG. 6. Through display of the sheet size error screen of FIG. 6, it is possible to prevent an occurrence of a feeding failure or a jam ascribable to the trailing edge regulating plate 814 (or side edge regulating plates 812 and 813) that is not set at a correct position.

Case of Placing Auxiliary Regulating Member

The trailing edge regulating plate 814 is formed so as to be movable by a distance between the arrows 8X1 and 8X2 illustrated in FIG. 3A, and is capable of regulating a trailing edge position of the sheets having a length of 190.5 mm to 355.6 mm. However, a moving range of the trailing edge regulating plate 814 has a limit defined by an applicable maximum size and an applicable minimum size, and is not capable of regulating the sheets having a small size of less than 190.5 mm. For example, in a case where A5 sheets having a sheet length of 148.0 mm or C6 envelopes having a sheet length of 162.0 mm or other such format are stored in the sheet feeding cassette, the trailing edge position of the sheets cannot be regulated by the trailing edge regulating plate 814. In this manner, in a case where sheets having a size smaller than the sheet size that can be regulated by the trailing edge regulating plate 814 are used, in this embodiment, an auxiliary regulating member 901 is placed between the trailing edge regulating plate 814 and the sheets. The auxiliary regulating member 901 is an attachment mountable to the sheet feeding cassette 120*a*, which is provided as an accessory to the sheet feeding cassette 120*a*, and serves to regulate the trailing edge position of the sheets in place of the trailing edge regulating plate 814.

Figure 8A:
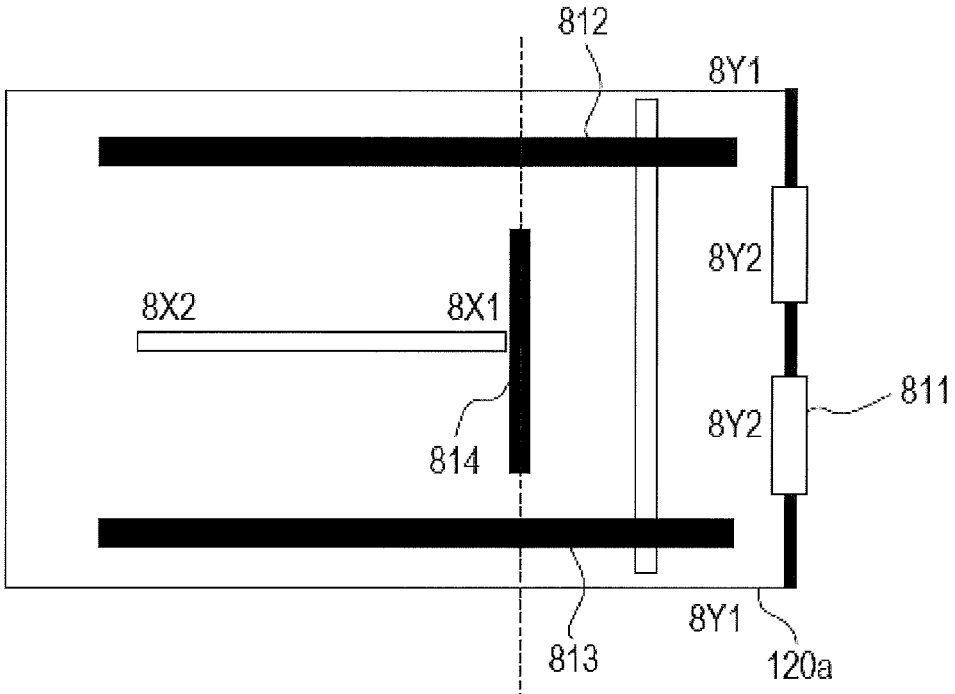
FIG. 8A and FIG. 8B are schematic views for illustrating how an auxiliary regulating member is mounted to the sheet feeding cassette.
Figure 8B:
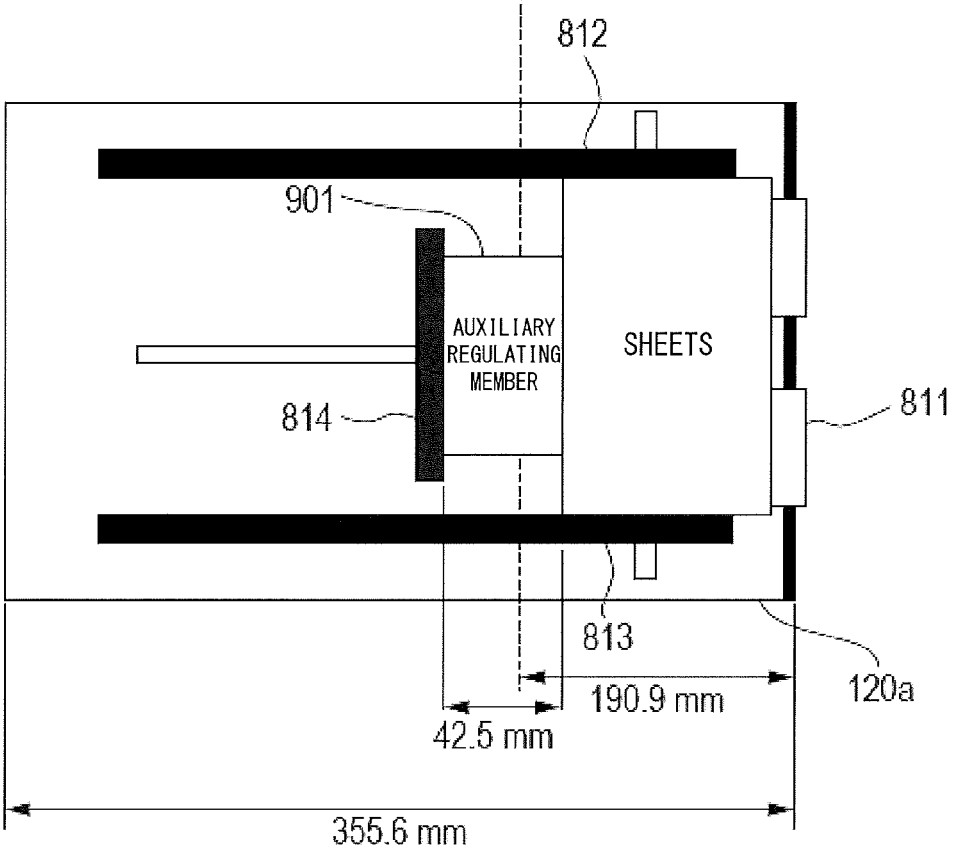

FIG. 8A and FIG. 8B are views for illustrating an example of how the auxiliary regulating member 901 is mounted to the trailing edge regulating plate 814 inside the sheet feeding cassette 120*a*. The broken line of FIG. 8B indicates a position for the minimum size to which the trailing edge regulating plate 814 is allowed to slide. It is assumed that the auxiliary regulating member 901 may be placed between the sheets and the trailing edge regulating plate 814 in order to stack sheets having a size (for example, A5 size being 148.0 mm) less than the minimum size to the position of which the trailing edge regulating plate 814 is allowed to slide.

Flow Chart for Illustrating Processing for Displaying Sheet Size Error Screen

Figure 7:
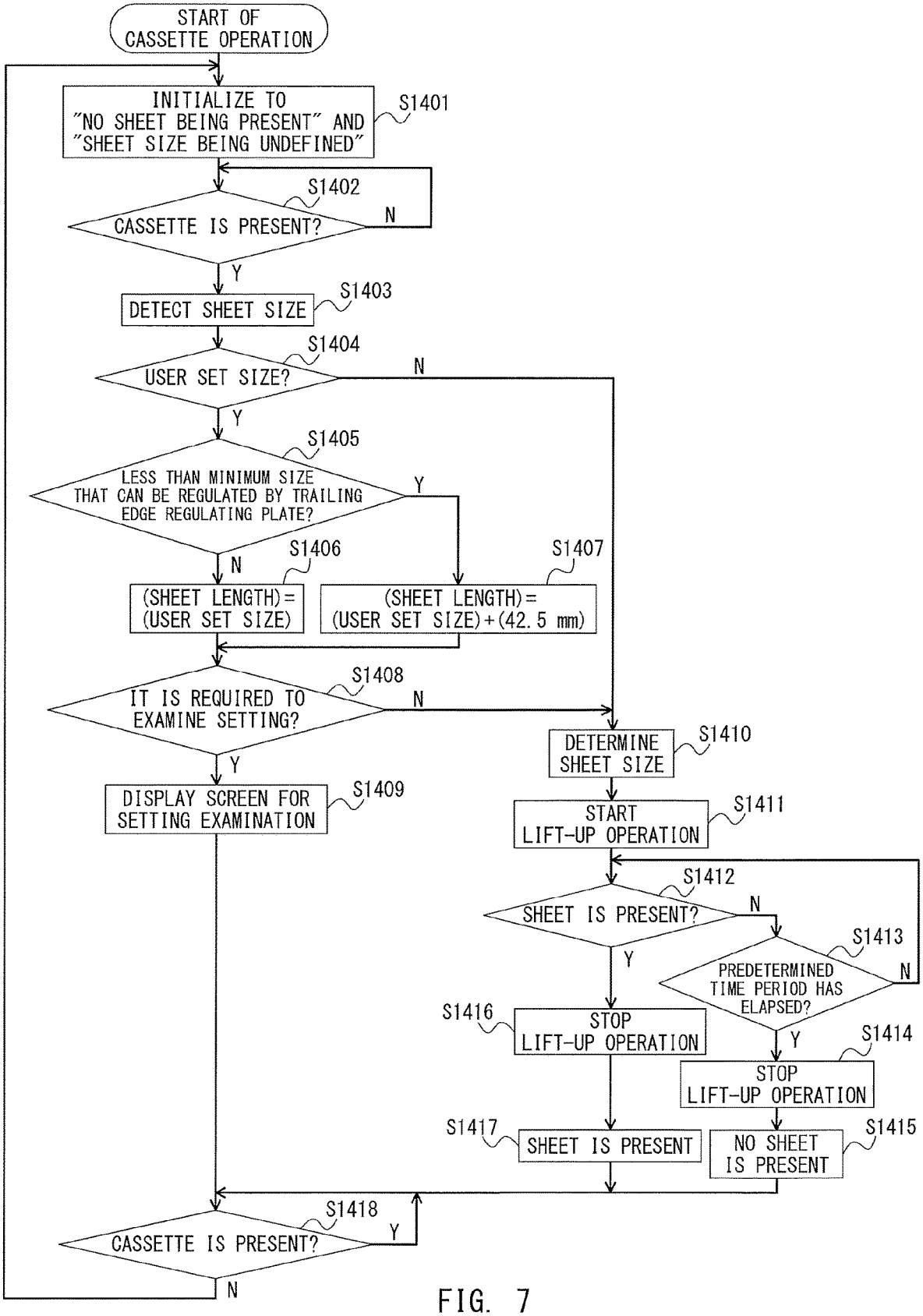
FIG. 7 is an explanatory flow chart for illustrating processing for comparing the user set size and an automatically detected size.

FIG. 7 is an explanatory flow chart for illustrating processing for displaying the sheet size error screen based on the user set size and a result of determination of the automatically detected size. The processing of FIG. 7 is executed when the image forming apparatus is powered on, when the sheet feeding cassette 120*a* is closed, or when the user sets the sheet size. The steps illustrated in the flow chart of FIG. 7 are executed by the CPU 201 in accordance with the program stored in the ROM 202.

In Step S1401, the CPU 201 initializes information on the sheet feeding cassette 120*a* stored in the RAM 203 to "no sheet being present" and "sheet size being undefined". Subsequently, in Step S1402, the CPU 201 determines whether or not the sheet feeding cassette 120*a* is mounted to the main body 819 based on detection results obtained by the switches SW0, SW1, and SW2 of the sheet width detection sensor 818 and the switches SW3, SW4, and SW5 of the sheet length detection sensor 817. When all the switches SW0 to SW5 are in an off state, the CPU 201 determines that the sheet feeding cassette 120*a* is not mounted to the main body 819. Meanwhile, when any one of the switches SW0 to SW5 is in an on state, the CPU 201 determines that the sheet feeding cassette 120*a* is mounted. When it is determined in Step S1402 that the sheet feeding cassette 120*a* is mounted, the CPU 201 advances to the processing of Step S1403. In Step S1403, the CPU 201 detects the size of sheets based on the positions of the trailing edge regulating plate 814 and the side edge regulating plates 812 and 813. This detection method is as described above with reference to FIG. 5. The sheet size detected in Step S1403 is referred to as "automatically detected size".

In Step S1404, the CPU 201 examines a sheet setting for each sheet feeding cassette, and determines whether or not the sheet setting is equal to a sheet setting made by the user via a sheet size setting screen of FIG. 4B. When a result of the determination is "Yes" in Step S1404, the CPU 201 advances to Step S1405. When a result of the determination is "No" in Step S1404, the CPU 201 advances to Step S1410. When a result of the determination is "No" in Step S1404, the CPU 201 sets the information on the automatically detected sheet size (automatically detected size) for the sheet feeding cassette 120*a*. That is, the sheet size identified in accordance with the detected positions of the trailing edge regulating plate 814 and the side edge regulating plates 812 and 813 is determined as the sheet size for the sheet feeding cassette 120*a*.

In Step S1405, the CPU 201 determines whether or not the sheet length of the user set size in the feeding direction is less than a minimum length (predetermined length) that enables the movement of the trailing edge regulating plate 814. Specifically, the CPU 201 determines whether or not the length (sheet length) in the feeding direction X of the user set size is in a range of equal to or greater than 148.0 mm and less than 190.5 mm. A sheet size within this range is a size less than the size of the sheets that can be regulated by the trailing edge regulating plate 814. Therefore, the auxiliary regulating member 901 is assumed to be placed between the trailing edge regulating plate 814 and the sheets. In this embodiment, a comparison is performed with the automatically detected size in consideration of the length of the auxiliary regulating member 901 in the feeding direction X. In this embodiment, the length of an auxiliary regulating member in the feeding direction is 42.5 mm. In view of this, a length obtained by adding 42.5 mm to the user set size is regarded as the user set size. That is, in Step S1405, the CPU 201 sets a length having a value obtained by adding 42.5 mm to the user set size as the sheet length.

Figure 6:
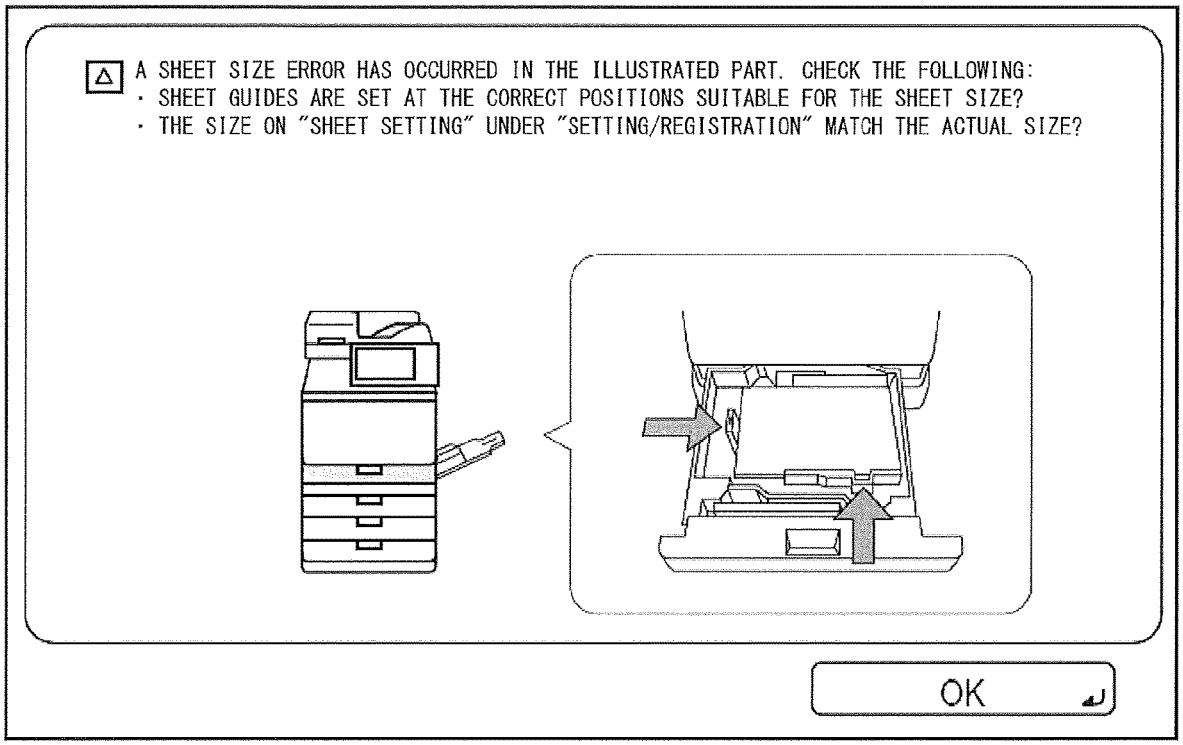
FIG. 6 is an illustration of a sheet size error screen.

After that, in Step S1408, the CPU 201 compares the user set size and the automatically detected sheet size to determine whether or not both match each other. This determination is performed with reference to the tables of FIG. 5A and FIG. 5B. When it is determined in Step S1408 that the user set size and the automatically detected size do not match each other, the CPU 201 advances to the processing of Step S1409. In Step S1409, the CPU 201 causes the operating device 1003 to display the sheet size error screen illustrated in FIG. 6. The sheet size error screen illustrated in FIG. 6 is a screen for notifying that the user set size received by the operation input device 306 and the automatically detected size exhibit a mismatch. The sheet size error screen illustrated in FIG. 6 is also a screen for prompting the user to adjust the trailing edge regulating plate 814 and the side edge regulating plates 812 and 813 at positions suitable for the user set size. In this case, the CPU 201 maintains the state of the sheet feeding cassette 120*a* at the state of "no sheet being present" and "sheet size being undefined" set in the initialization of Step S1401. This imposes a limitation on the image formation on a sheet fed from the sheet feeding cassette 120*a*.

Meanwhile, when it is determined in Step S1408 that the user set size and the automatically detected size match each other, the CPU 201 advances to the processing of Step S1410. In Step S1410, the CPU 201 determines that the user set size is the size of the sheets stored in the sheet feeding cassette 120*a*.

In Step S1411, as described above, the CPU 201 starts the lift-up operation for lifting up the sheets stacked on the sheet feeding cassette 120*a* to such a height as to enable sheet feeding. In Step S1412, the CPU 201 determines the presence or absence of a sheet based on the detection result obtained by the sheet presence sensor 820. When it is determined in Step S1412 that no sheet is present based on the detection result obtained by the sheet presence sensor 820, the CPU 201 determines in Step S1413 whether or not a predetermined time period has elapsed. When determining that the predetermined time has not elapsed, the CPU 201 returns to the processing of Step S1412. When it is determined in Step S1413 that the predetermined time has elapsed, that is, when a sheet surface cannot be detected from the sheets stacked on the sheet feeding cassette 120*a* by the sheet presence sensor 820 even after a lapse of the predetermined time period, the CPU 201 stops the lift-up operation in Step S1414. In Step S1415, the CPU 201 determines that no sheet is stacked on the sheet feeding cassette 120*a*. The CPU 201 replaces the information of "sheet size being undefined" set in Step S1401 by the user set size or the automatically detected sheet size. That is, the CPU 201 sets the state of the sheet feeding cassette 120*a* to a state of having a sheet present, and stores the user set size or the automatically detected sheet size in the RAM 203.

Meanwhile, when determining in Step S1412 that a sheet is present based on the detection result obtained by the sheet presence sensor 820, the CPU 201 advances to the processing of Step S1416. The CPU 201 determines that a sheet surface has been detected from the sheets stacked on the sheet feeding cassette 120*a*, and the CPU 201 stops the lift-up operation in Step S1416. In Step S1417, the CPU 201 sets the user set size or the automatically detected sheet size as the sheet size for the sheet feeding cassette 120*a*. That is, the CPU 201 sets the state of the sheet feeding cassette 120*a* to the state of having a sheet present, and stores the information on the user set size or the automatically detected size in the RAM 203. Then, the CPU 201 controls the printer 1002 to execute image formation based on the information on the sheet size stored in the RAM 203.

In Step S1418, the CPU 201 determines whether or not the sheet feeding cassette 120*a* is mounted to the main body 819 of the container. Specifically, the CPU 201 determines that the sheet feeding cassette 120*a* is mounted when any one of the switches SW0 to SW5 is in an on state based on the detection results obtained by the sheet width detection sensor 818 and the sheet length detection sensor 817. Meanwhile, when all the switches SW0 to SW5 are in an off state, the CPU 201 determines that the sheet feeding cassette 120*a* is not mounted. When it is determined in Step S1418 that the sheet feeding cassette 120*a* is absent, the CPU 201 returns to the processing of Step S1401, and the CPU 201 sets the state of the sheet feeding cassette 120*a* to the state of having no sheet present and the sheet size undefined.

According to this embodiment, when the length (sheet length) in the feeding direction of the user set size is longer than the predetermined length, a comparison is performed between the user set size and the automatically detected size. Meanwhile, when the length (sheet length) in the feeding direction of the user set size is shorter than the predetermined length, a comparison is performed between a value obtained by adding the length (42.5 mm) of the auxiliary regulating member to the user set size and the automatically detected size. That is, when sheets having a size smaller than a movable range of a trailing edge regulating plate is set, a comparison is performed between the value obtained by adding the length of the auxiliary regulating member to the user set size and the automatically detected size. With this configuration, the image forming apparatus including the container in which the auxiliary regulating member can be placed between the trailing edge regulating plate and the sheets can be caused to appropriately display a warning.

This embodiment has been described by taking the length (190.0 mm) of a minimum sheet that can be regulated by the trailing edge regulating plate 814 as an example of the predetermined length, but another reference value may be set as the predetermined length. For example, a length determined based on the size of the auxiliary regulating member 901 provided as an accessory may be set as the predetermined length.

Further, in this embodiment, the value obtained by adding the length of the auxiliary regulating member to the user set size is compared with the automatically detected size, but a value obtained by subtracting the length of the auxiliary regulating member from the automatically detected size may be compared with the user set size.

Further, as an example of displaying a warning, the example of displaying information for prompting the user to examine whether or not the trailing edge regulating plate and the side edge regulating plates are set at the positions suitable for the sheet size and the example of displaying the information for instructing the user to examine whether or not the user set size matches the size of the sheets supplied to the sheet feeding cassette have been described. However, contents to be displayed as the warning are not limited thereto. For example, only a warning for notifying the user of a sheet setting error may be displayed.

As described above, according to the present invention, the image forming apparatus including the sheet container in which an attachment can be mounted to the trailing edge regulating plate can be caused to appropriately display a warning.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-199602, filed Oct. 13, 2017, which is hereby incorporated by reference herein in its entirety.

What is claimed is:

1. An image forming apparatus, comprising:

a container configured to store a sheet;

an image forming unit configured to form an image on the sheet fed from the container;

a trailing edge regulating plate, which is movable in a feeding direction of the sheet inside the container, and is configured to regulate a position of a trailing edge of the sheet in the feeding direction;

a detector configured to detect a length of the sheet in the feeding direction based on the position of the trailing edge regulating plate;

a receiver configured to receive a length of the sheet in the feeding direction to be set for the container based on a user instruction;

an attachment, which is to be mounted to the trailing edge regulating plate, and is configured to regulate the position of the trailing edge of the sheet having a sheet size smaller than an applicable sheet size of the trailing edge regulating plate; and a control unit configured to:

compare, in a case in which a length in the feeding direction of the sheet received by the receiver is longer than a predetermined length, the length of the sheet received by the receiver with the length of the sheet detected by the detector;

notify a user of a warning based on when the length of the sheet received by the receiver and the length of the sheet detected by the detector are different;

compare, in a case in which the length in the feeding direction of the sheet received by the receiver is shorter than the predetermined length, a sum length with the length of the sheet detected by the detector, the sum length being a length obtained by adding the length of the sheet received by the receiver and a length of the attachment in the feeding direction; and notify the user of the warning in a case in which the sum length and the length of the sheet detected by the detector differ from each other.

2. The image forming apparatus according to claim 1, wherein the notifying the user of the warning involves displaying an error screen indicating that the length of the sheet received by the receiver and the length of the sheet detected by the detector exhibit a mismatch.

3. The image forming apparatus according to claim 1, wherein the notifying the user of the warning involves prompting the user to adjust the trailing edge regulating plate at a position suitable for the size of the sheet received by the receiver.

4. The image forming apparatus according to claim 1, wherein the receiver is configured to receive an irregular size.

5. The image forming apparatus according to claim 1, wherein the container comprises a sheet feeding cassette.

6. The image forming apparatus according to claim 1, wherein the predetermined length comprises a length shorter than the length of the sheet in the feeding direction to be regulated by the trailing edge regulating plate.

7. An image forming apparatus, comprising:

a container configured to store a sheet;

an image forming unit configured to form an image on the sheet fed from the container;

a trailing edge regulating plate, which is movable in a feeding direction of the sheet inside the container, and is configured to regulate a position of a trailing edge of the sheet in the feeding direction;

a detector configured to detect a length of the sheet in the feeding direction based on the position of the trailing edge regulating plate;

a receiver configured to receive a length of the sheet in the feeding direction to be set for the container based on a user instruction;

an attachment, which is to be mounted to the trailing edge regulating plate, and is configured to regulate the position of the trailing edge of the sheet having a sheet size smaller than an applicable sheet size of the trailing edge regulating plate; and a control unit configured to:

compare, in a case in which a length in the feeding direction of the sheet received by the receiver is longer than a predetermined length, the length of the sheet received by the receiver with the length of the sheet detected by the detector;

notify a user of a warning when the length of the sheet received by the receiver and the length of the sheet detected by the detector are different;

compare, in a case in which the length in the feeding direction of the sheet received by the receiver is shorter than the predetermined length, the length of the sheet received by the receiver with a length obtained by subtracting a length of the attachment in the feeding direction from the length of the sheet detected by the detector; and notify the user of the warning in a case in which the length of the sheet received by the receiver and the length obtained by subtracting the length of the attachment in the feeding direction from the length of the sheet detected by the detector differ from each other.

* * * * *